United States Patent [19]

Grossmann et al.

[11] Patent Number: 4,922,820

[45] Date of Patent: May 8, 1990

[54] DEVICE FOR REMOVING SOIL PARTICLES FROM THE PLATE CYLINDER OF AN OFFSET PRINTING MACHINE

[76] Inventors: Werner Grossmann, Am Jobstenholz, 9 Seukendorf, Fed. Rep. of Germany, 8501; Hans G. Herzing, Hildebrandstr., 22 Lindelburg, Fed. Rep. of Germany, 8501; Manfred Piltz, Hansengarten, 64 Nuernberg, Fed. Rep. of Germany, 8500

[21] Appl. No.: 184,362

[22] Filed: Apr. 21, 1988

[30] Foreign Application Priority Data

Apr. 22, 1987 [DE] Fed. Rep. of Germany ..... 3713433

[51] Int. Cl.[5] ..... B41F 35/02

[52] U.S. Cl. ..... 101/425

[58] Field of Search ..... 101/365, 169, 157, 350, 101/425, 423

[56] References Cited

U.S. PATENT DOCUMENTS

| | | | |
|---|---|---|---|
| 3,822,642 | 7/1974 | Grindeland . | |
| 4,058,058 | 11/1977 | Hantscho | 101/365 |
| 4,082,038 | 4/1978 | Ueno et al. | 101/425 |
| 4,311,094 | 1/1982 | Ellison . | |
| 4,463,675 | 8/1984 | Ottenhues | 101/169 X |

FOREIGN PATENT DOCUMENTS 8706528 11/1987 European Pat. Off. .

*Primary Examiner*—J. Reed Fisher

*Attorney, Agent, or Firm*—Fleit, Jacobson, Cohn, Price, Holman & Stern

[57] ABSTRACT

A device for removing soil particles from the plate cylinder of an offset printing machine extends over the entire length of the plate cylinder and engages the plate cylinder in the region between the ink transfer to the rubber cylinder and the dampening for cleaning the plate cylinder in a manner which is safe for the operator, is rapid, and is fully efficacious, while generating minimal rejects, and comprises a plurality of pneumatic cylinders disposed distributed over the entire length of the plate cylinder, having piston plungers which are non-rotatable and bear corresponding elastic wiping implements on their free ends. Adjacent wiping elements have a reversed orientation with respect to each other and laterally overlap, and the excursion length of each piston plunger is slightly greater than the distance between the forward edge of the wiping implement in the retracted position and the surface of the plate cylinder.

20 Claims, 2 Drawing Sheets

DEVICE FOR REMOVING SOIL PARTICLES FROM THE PLATE CYLINDER OF AN OFFSET PRINTING MACHINE

BACKGROUND OF THE INVENTION

1. Field Of The Invention

The invention relates to a device for removing soil particles from the plate cylinder of an offset printing machine, which device extends over the entire length of the plate cylinder and engages the plate cylinder in the region between the ink transfer to the rubber cylinder and the dampening.

2. Description Of The Prior Art

In offset printing, the plate cylinder becomes repeatedly soiled. The soils may be comprised of fibers of paper or cardboard from the material being printed on, balls or clumps of printing ink, or dust from the air. They can give rise to unprinted spots on the surface being printed. To eliminate this problem, either the printing machine must be stopped for hand removal of the soil particles or else a device must be applied against the rotating plate cylinder which device removes the soil particles. Stopping the press reduces the output and increases rejects which necessarily result whenever the press is stopped. On the other hand, engaging the running press with cleaning tools is hazardous to the operator, and is indeed prohibited. Further, because this (running-press) technique can only be carried out from the ink-application side, it results in an undesirable partial removal of ink.

Accordingly, there has been much research directed at means of removing soils from the plate cylinders of offset printing machines which means are free from these disadvantages. In this connection, solutions have become known of the types described, e.g., in Ger. OSs 25 22 743, 27 15 445, 28 50 448, 34 10 376, and also 36 20 156. The claimed matter of the first four cited German references involves devices in which a guide means is provided which is parallel to the rotational axis of the plate cylinder in the ink-free region of the plate cylinder, and which extends over the entire length of the plate cylinder. The guide means bears a driven cleaning implement. These known devices have not found acceptance in the art, however. The reasons for this are, first, that the space requirements for the guide means, cleaning implement, and drive are so great that the device is virtually impossible to accommodate in the very narrow region of the dampening system, and secondly, that the cleaning implement must be adjusted with each application, which requires high accuracy because of the sometimes only local point contact between the implement and the cylinder; and further, when soil particles are present at several locations they must be removed sequentially, which necessitates an extending cleaning time and therefore a high reject rate (amount of printed work which must be discarded). Ger. OS 3,620,156 discloses a device wherein a cleaning implement extends over the entire length of the plate cylinder, the implement having the form of an application cylinder of the dampening system. However, this device also does not produce the desired result. The means whereby the application cylinder is enabled to function as a cleaning implement are mechanically complex. Furthermore, the cleaning action is unreliable, because if the plate cylinder and application cylinder are not exactly parallel the soil particles will not be removed over the entire length of the cylinder. In addition, the force of the application cylinder against the plate cylinder is relatively low, whereby the result may be that the soil particles are only mashed down instead of being removed.

BRIEF SUMMARY OF THE INVENTION

The object of the invention is to provide a cleaning device which does not have these drawbacks of known devices, but enables the plate cylinder of a running offset printing machine to be cleaned in a manner which is safe for the operator, is rapid, and is fully efficacious, while generating a minimal number of rejects. The starting point of the invention which solves this problem is a known device of the type described initially supra. The problem is solved in the inventive device in that a plurality of pneumatic cylinders are disposed distributed over the entire length of the plate cylinder, having piston plungers which are non-rotatable and which bear corresponding elastic wiping implements on their free ends. Neighboring wiping implements have a reversed orientation with respect to each other and laterally overlap, and the attainable excursion length of each piston plunger is slightly greater than the distance between the forward edge of the wiping implement in the retracted position and the surface of the plate cylinder.

With this arrangement, the wiping implements form a closed front which covers the entire length of the plate cylinder, so that when the offset printing machine is in operation the front can be brought against the surface of the plate cylinder segmentally. Accordingly, if only one soil particle is present, it is sufficient to advance only a single segment, i.e., a single wiping implement, whereas if several soil particles are present, distributed over the length of the plate cylinder, they can be removed in one stroke by advancing several segments, i.e., several wiping implements. The alternating reversed orientation and overlapping sides of the wiping implements prevent development of a dead zone between neighboring wiping implements. The length chosen for the available excursion ensures firm pressing of the advanced wiping implements against the plate cylinder under all conditions, as well as compensation for any wear which may occur to the wiping implements. The elasticity of the material of the wiping implements, in combination with the yielding nature of the pneumatic drives, ensures that the surface of the plate cylinder will not suffer damage. Finally, compact pneumatic cylinders of a type currently commercially available may be employed to keep the space requirements for the device low, whereby the device may readily be mounted on the side of the dampening system.

Accordingly to an advantageous refinement of the invention, the pneumatic cylinders (singly, or jointly in unison) are controllable in lag-free fashion, i.e. with the least possible time-lag between the actuation and operation of the pneumatic cylinders, from the control panel of the printing machine, and are affixed to a strip which extends over the entire length of the plate cylinder and parallel to the longitudinal axis of the cylinder. The piston plungers of the pneumatic cylinders all have the same excursion length. The cleaning implement is actuated from the same position from which the ink zone screws are controlled to adjust the ink layer thickness. The affixing of all the pneumatic cylinders to a single strip enables substantially complete preassembly of the device, and simplifies installation and removal.

It has proven particularly advantageous if the wiping implements are each comprised of a rear base part and a front contact blade, both of which have a generally rectangular shape, with the base part being substantially thicker and longer than the contact blade, and if the contact blade has lateral extensions on both sides of the base part. The thickness and length of the base part should be about three times the respective dimensions of the contact blade. This produces conditions whereby, according to another feature of the invention, a mounting opening for inserting the piston plunger may be provided which opening extends centrally into the base part from the rear side. The comparatively weak structure of the contact blade, which extends preferably about 5 mm on each side beyond the base part, facilitates elastic deformation of the blade when the wiping implement is pressed against the plate cylinder.

According to a particularly advantageous feature of the invention, the width, i.e., along the cylinder axis, of each base part is equal to the width of the corresponding ink zone appearing on the control panel of the offset printing machine. This correspondence greatly facilitates the operation of the cleaning implement, because it eliminates the tedious process of determining which wiping implement should be actuated to remove a given soil particle, and enables actuation "at a glance".

In order to prevent a situation where soil particles which adhere to the wiping implements after they have been removed from the plate cylinder are then redeposited when the wiping implements are reapplied to the plate cylinder, it is recommended to provide a doctor blade which can be applied against the bottom of each wiping implement on its retraction stroke, thereby scaping off adhering soils.

BRIEF DESCRIPTION OF THE DRAWINGS

A preferred exemplary embodiment of the inventive cleaning device will now be described in detail with reference to the drawings wherein.

DETAILED DESCRIPTION

Figure 1:
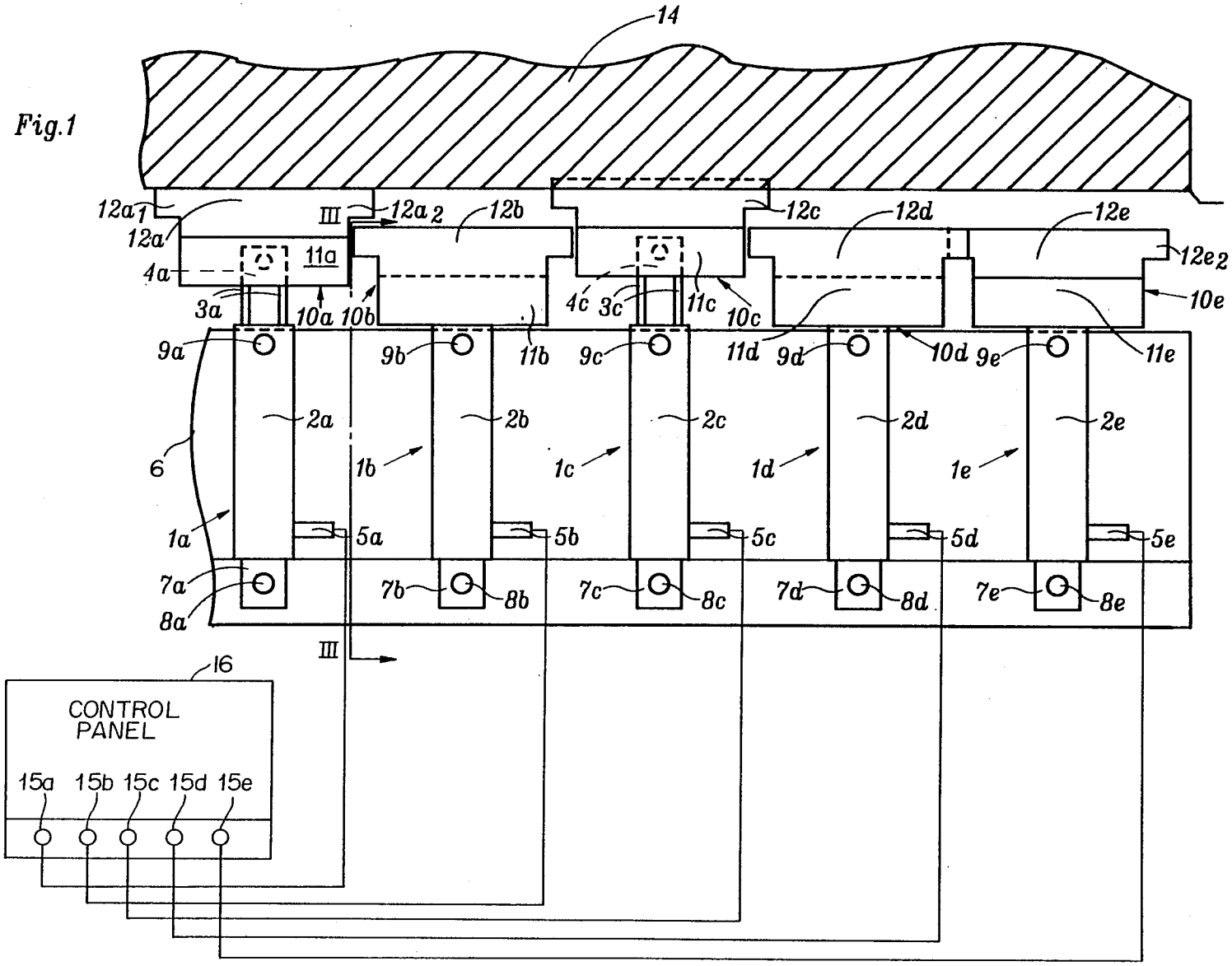
FIG. 1 is a top plan view showing an assembly of the wiping implements and actuators in accordance with the invention, the plate cylinder being shown in cross section and the control panel shown schematically.

Five pneumatic cylinders 1*a*–1*e* are shown in FIG. 1, having corresponding housings 2*a*–2*e* with dimensions of 48×12×5 mm and piston plungers 3, of which only legs 3*a* and 3*c* are visible which are part of the forked construction of the plungers, with the free ends of the respective two legs of the fork being connected by a crosspiece 4 (of which only 4*a* and 4*c* are indicated in FIG. 1). The compressed air lines 5*a*–5*e* to each pneumatic cylinder are schematically as connected to a control panel 16 also shown schematically and having mounted thereon pneumatic controls 15*a*–15*e* which are manually operated for connecting each air line to a compressed air source (not shown) for selectively operating the pneumatic cylinders 1*a*–1*e*.

The pneumatic cylinders 1*a*–1*e* are attached by screws to a strip 6 which passes through the entire device extending the length of the plate cylinder. For purposes of this attachment, the cylinders 1*a*–1*e* are supplied with mounting lugs 7*a*–7*e* having holes 8*a*–8*e*, and also have bores 9*a*–9*e* through the housings. The mounting screws passing through bores 9*a*–9*e* extend between the two forks of the piston plungers 3.

Figure 3:
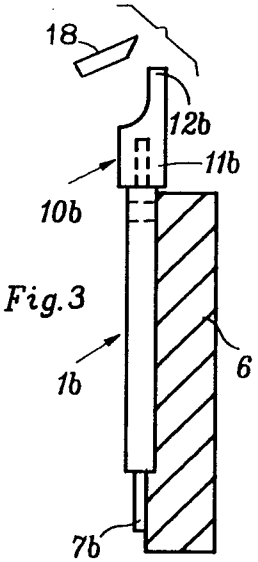
FIG. 3 is a cross-sectional view taken along line III—III of FIG. 1.

Wiping implements 10*a*–10*e* comprised of elastic material are pushed over the free ends of the piston plungers 3 and crosspiece 4. These implements are comprised of respective rear base parts 11*a*–11*e* and front contact blades 12*a*–12*e* each having a forward edge for contacting the outer surface of the plate cylinder. The base parts 11*a*–11*e* are substantially thicker and longer than the contact blades 12*a*–12*e*, and each base part has a mounting opening 13 for receiving the piston plunger 3 and crosspiece 4. As seen particularly in FIG. 3, the base part 11*a*–11*e* undergoes a curved transition into the contact blade 12*a*–12*e*, and each such blade has lateral extensions 12*a*1, 12*a*2; . . . 12*e*2 on each of its two sides.

Figure 2:
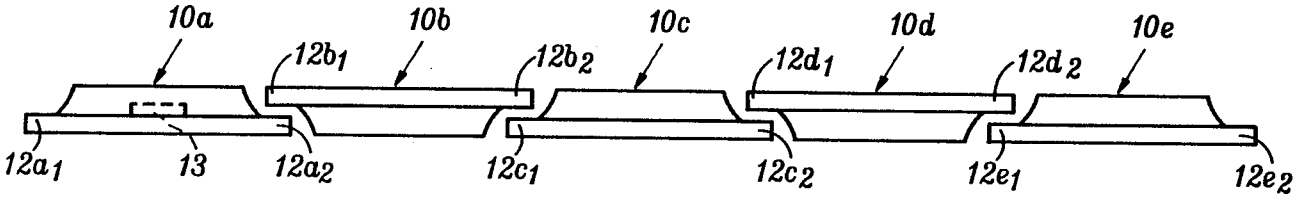
FIG. 2 is a front elevational view of the wiping implements only of FIG. 1.

As seen from FIGS. 1 and 2, the wiping implements 10*a*–10*e* as a set oriented with respect to each other such that the contact blades 12*a*, 12*c*, and 12*e* of the first, third, and fifth wiping implements 10*a*, 10*c*, and 10*e* are on the underside, and the contact blades 12*b* and 12*d* of the second and fourth wiping implements 10*b* and 10*d* are on the top side, whereby adjacent lateral extensions (e.g., 12*a*2 and 12*b*1) overlap. In this way a closed front of the wiping implements 10*a*–10*e* is formed which covers the entire length of the plate cylinder 14. In FIG. 1, wiping implements 10*b*, 10*d*, and 10*e* are shown in retracted position, and wiping implement 10*a* is shown in advanced position (pressed against the surface of the plate cylinder).

Wiping implement 10*c* is shown in an even farther advanced position than 10*a*, which is slightly beyond the normally attainable position of wiping implement 10*c*. It is shown merely to indicate the maximum excursion length, amounting to about 10 mm with pneumatic cylinders 1*a*–1*e* of the dimensions stated supra. Because the maximum excursion length is slightly greater than the distance between the forward edges of the wiping implements 10*a*–10*e* and the parallel surface of the plate cylinder 14, when the pneumatic cylinders 1*a*–1*e* are actuated the wiping implements 10*a*–10*e* will always be firmly pressed against the surface of the plate cylinder 14, and any wear which has occurred on the contact blades 12*a*–12*e* will be compensated for.

As mentioned above, a doctor blade 18 can be provided for applying against the bottom of each wiping implement during its retraction stroke for scraping off soils adhering thereon. An example of such a doctor blade is shown schematically in FIG. 3.

We claim:

1. Apparatus for removing undesired particles from the outer surface of a rotatable plate cylinder of an offset printing machine comprising:

a plurality of actuating means mounted in relative spaced relationship along at least part of the length of the plate cylinder in spaced relation to the outer surface thereof;

a plunger mounted on each actuating means for movement toward and away from the plate cylinder;

a wiping implement mounted on each plunger for movement thereby into and out of wiping engagement with the outer surface of the plate cylinder for removing undesired particles therefrom;

operating means for operating said actuating means so that said wiping implements are movable into and out of wiping engagement with the plate cylinder outer surface individually for wiping a portion of said outer surface of the plate cylinder and in any combination thereof for wiping a plurality of portions of said outer surface of the plate cylinder; and lateral projections extending from said wiping implements in the axial longitudinal direction of the plate cylinder, said lateral projections being shaped so that adjacent lateral projections on adjacent wiping elements overlap each other in said longitudinal direction and overlap each other in a direction substantially transverse to said longitudinal direction, and adjacent wiping implements wipe said outer surface in an overlapping manner.

2. An apparatus as claimed in claim 1 wherein:

said actuating means comprises a pneumatic cylinder-piston means; and said plunger is connected with the piston of said cylinder-piston means to form a piston plunger.

3. An apparatus as claimed in claim 1 wherein:

said wiping implements are resilient and each wiping implement has a forward edge movable between a wiping position when actuated into engagement with said outer surface of the plate cylinder and a retracted position when unactuated; and said plunger has a stroke slightly greater than the distance between said outer surface of the plate cylinder and said forward edge when in said retracted position.

4. An apparatus as claimed in claim 2 wherein:

said wiping implements are resilient and each wiping implement has a forward edge movable between a wiping position when actuated into engagement with said outer surface of the plate cylinder and a retracted position when unactuated; and said plunger has a stroke slightly greater than the distance between said outer surface of the plate cylinder and said forward edge when in said retracted position.

5. An apparatus as claimed in claim 1 and further comprising:

an actuator mounting strip extending over at least part of the axial length of the plate cylinder and substantially parallel to the longitudinal axis of the plate cylinder; and means for mounting said actuating means on said actuator mounting strip.

6. An apparatus as claimed in claim 4 and further comprising:

an actuator mounting strip extending over at least part of the axial length of the plate cylinder and substantially parallel to the longitudinal axis of the plate cylinder; and means for mounting said actuating means on said actuator mounting strip.

7. An apparatus as claimed in claim 1 wherein:

said operating means comprises a control panel; and control means are provided on said control panel operatively connected to each actuating means for selectively controlling said actuating means.

8. An apparatus as claimed in claim 6 wherein:

said operating means comprises a control panel; and control means are provided on said control panel operatively connected to each actuating means for selectively controlling said actuating means.

9. An apparatus as claimed in claim 1 wherein:

said wiping implement is non-rotatable.

10. An apparatus as claimed in claim 2 wherein:

said piston plunger is non-rotatable and said wiping implement is non-rotatably mounted on said piston plunger.

11. An apparatus as claimed in claim 8 wherein:

said piston plunger is non-rotatable and said wiping implement is non-rotatably mounted on said piston plunger.

12. An apparatus as claimed in claim 1 wherein said wiping implements each comprise:

a rear base part adjacent said actuating means and having a substantially rectangular shape; and a front contact blade engageable with the outer surface of the plate cylinder and having a substantially rectangular shape:

said rear base part having a greater thickness than said front contact blade and said lateral projections extending from said front contact blade.

13. An apparatus as claimed in claim 12 wherein:

each wiping implement has two sides; and said lateral projections extend from both sides.

14. An apparatus as claimed in claim 12 and further comprising:

a mounting opening in said rear base part into which said plunger is insertable for mounting said wiping implement on said plunger.

15. An apparatus as claimed in claim 12 wherein:

said thickness of said rear base part is approximately three times the thickness of said contact blade.

16. An apparatus as claimed in claim 21 wherein:

said lateral projections extend approximately 5 mm laterally beyond said rear base part.

17. An apparatus as claimed in claim 21 wherein:

said operating means comprises a control panel; and control means are provided on said control panel operatively connected to each actuating means for selectively controlling said actuating means.

18. An apparatus as claimed in claim 17 wherein:

a plurality of ink zones are provided on said control panel;

a wiping implement is provided for each ink zone; and each rear base part has a lateral width substantially equal to the width of the corresponding ink zones.

19. An apparatus as claimed in claim 3 and further comprising:

means engageable with each wiping implement during retraction thereof for removing undesired particles from each implement.

20. An apparatus as claimed in claim 5 wherein:

said mounting strip extends over substantially the entire axial length of the plate cylinder; and said wiping implements extend laterally over substantially the entire axial length of the outer surface of the plate cylinder.

* * * * *